US009845681B2

(12) United States Patent
Ziehr et al.

(10) Patent No.: US 9,845,681 B2
(45) Date of Patent: Dec. 19, 2017

(54) VACUUM PUMP FOR A MOTOR VEHICLE

(71) Applicant: Magna Powertrain Bad Homburg GmbH, Bad Homburg (DE)

(72) Inventors: Daniel Ziehr, Remscheid (DE); Freddy Schönwald, Hückeswagen (DE); Carsten Sczesny, Bochum (DE); Benjamin Pyrdok, Bergisch Gladbach (DE); Dietmar Moeser, Marienheide (DE)

(73) Assignee: Magna Powertrain Bad Homburg GmbH, Bad Homburg (DE)

( * ) Notice: Subject to any disclaimer, the term of this patent is extended or adjusted under 35 U.S.C. 154(b) by 92 days.

(21) Appl. No.: 14/442,930

(22) PCT Filed: Oct. 25, 2013

(86) PCT No.: PCT/DE2013/100370
§ 371 (c)(1),
(2) Date: Jul. 13, 2015

(87) PCT Pub. No.: WO2014/075660
PCT Pub. Date: May 22, 2014

(65) Prior Publication Data

US 2015/0345498 A1 Dec. 3, 2015

(30) Foreign Application Priority Data

Nov. 19, 2012 (DE) ..... 10 2012 111 110

(51) Int. Cl.
*F01C 19/00* (2006.01)
*F03C 2/00* (2006.01)
(Continued)

(52) U.S. Cl.
CPC ..... *F01C 21/10* (2013.01); *F04C 18/3448* (2013.01); *F04C 25/02* (2013.01);
(Continued)

(58) Field of Classification Search
CPC .... F04C 18/344; F04C 18/3448; F04C 25/02; F04C 27/00; F04C 7/008; F04C 29/065;
(Continued)

(56) References Cited

U.S. PATENT DOCUMENTS 3,656,869 A * 4/1972 Leonard ..... F04C 14/226 418/26
4,781,545 A 11/1988 Yokomizo et al.
(Continued)

FOREIGN PATENT DOCUMENTS

DE 4239575 A1 5/1994
DE 19936644 A1 2/2001
(Continued)

OTHER PUBLICATIONS

International Search Report dated Jan. 16, 2015.
Written Opinion dated Jan. 16, 2015.

*Primary Examiner* — Theresa Trieu
(74) *Attorney, Agent, or Firm* — Dickinson Wright PLLC

(57) ABSTRACT

The invention relates to a vacuum pump for a motor vehicle, comprising a pump housing surface, on which a noise reduction hood delimiting a sound damping volume is mounted. The invention is characterized in that a multi-functional decoupling element is located between the pump housing surface and the noise reduction hood, said element carrying out a sealing function and a valve function in addition to a sound decoupling function.

15 Claims, 7 Drawing Sheets

Figure 1:
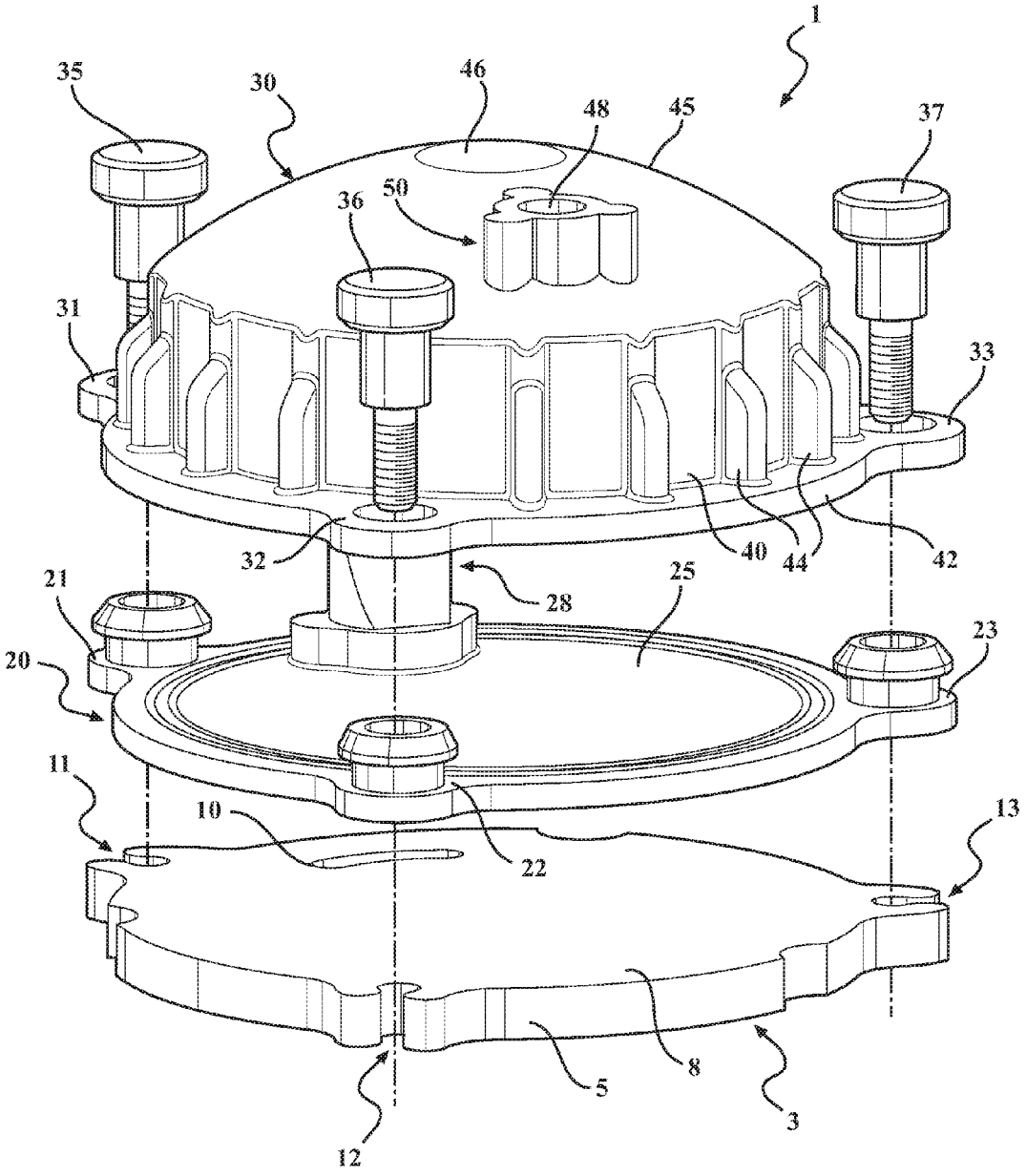

(51) Int. Cl.

| | |
|---|---|
| ***F03C 4/00*** | (2006.01) |
| ***F04C 2/00*** | (2006.01) |
| ***F01C 21/10*** | (2006.01) |
| ***F04C 18/344*** | (2006.01) |
| ***F04C 27/00*** | (2006.01) |
| ***F04C 29/12*** | (2006.01) |
| ***F04C 25/02*** | (2006.01) |
| ***F04C 29/06*** | (2006.01) |

(52) U.S. Cl.
CPC ..... *F04C 27/00* (2013.01); *F04C 27/008* (2013.01); *F04C 29/065* (2013.01); *F04C 29/068* (2013.01); *F04C 29/12* (2013.01); *F04C 29/124* (2013.01); *F04C 18/344* (2013.01); *F05C 2225/06* (2013.01); *F05C 2253/16* (2013.01)

(58) Field of Classification Search
CPC ..... F04C 29/068; F04C 29/12; F04C 29/124; F05C 2225/06; F05C 2253/16; F01C 21/10
USPC ..... 418/104, 140, 181, 152–153
See application file for complete search history.

(56) References Cited

U.S. PATENT DOCUMENTS

| | | | | |
|---|---|---|---|---|
| 7,134,856 | B2 * | 11/2006 | Muller | F04C 18/348 418/152 |
| 2004/0170516 | A1 | 9/2004 | Hinchey, Jr. | |
| 2005/0063853 | A1 | 3/2005 | Otte et al. | |
| 2008/0008612 | A1 | 1/2008 | Kim et al. | |
| 2011/0171041 | A1 | 7/2011 | Zhao et al. | |

FOREIGN PATENT DOCUMENTS

| | | | |
|---|---|---|---|
| DE | 102009056010 | A1 | 6/2011 |
| WO | WO2004074687 | A2 | 9/2004 |
| WO | 2007027168 | A1 | 8/2007 |
| WO | 2011134448 | A2 | 11/2011 |

* cited by examiner

VACUUM PUMP FOR A MOTOR VEHICLE

CROSS-REFERENCE TO RELATED APPLICATIONS

This application is a National Stage of International Application No. PCT/DE2013/100370 filed Oct. 25, 2013 which claims the benefit and priority of German Application No. DE 10 2012 111 110.3 filed Nov. 19, 2012. The entire disclosure of each of the above applications is incorporated herein by reference.

FIELD

The invention relates to a vacuum pump for a motor vehicle having a pump housing face, to which an acoustic enclosure is attached which delimits a sound damping volume.

BACKGROUND

The international publication WO 2011/134448 A2 has disclosed a vacuum pump having a pump housing, in which vacuum pump at least one pump housing part is formed from a sandwich sheet metal material with two sheet metal layers, between which a plastic layer is arranged, by way of which the sheet metal layers are decoupled in terms of oscillations from one another. The vacuum pump can comprise a muffler which is formed from the sandwich sheet metal material. Vacuum pumps of the generic type having acoustic enclosures are known from American laid-open specification US 2004/0170516 A1, American laid-open specification US 2011/171041 A1, U.S. Pat. No. 4,781,545, German laid-open specification DE 199 36 644 A1 and German laid-open specification DE 10 2009 056 010 A1.

SUMMARY

It is an object of the invention to further optimize a vacuum pump for a motor vehicle having a pump housing face, to which an acoustic enclosure is attached which delimits a sound damping volume, with regard to undesired sound development during operation of the vacuum pump for a motor vehicle.

The object is achieved in a vacuum pump for a motor vehicle having a pump housing face, to which an acoustic enclosure is attached which delimits a sound damping volume, by virtue of the fact that a multifunctional decoupling element is arranged between the pump housing face and the acoustic enclosure, which decoupling element performs both a sealing function and a valve function in addition to a sound decoupling function. The vacuum pump for a motor vehicle is preferably configured as a vane cell pump and is driven by an electric motor. In a motor vehicle, the vacuum pump for a motor vehicle serves to generate a vacuum. The motor vehicle is preferably configured as a hybrid vehicle with an internal combustion engine drive and a further drive, for example an electric motor drive. When the internal combustion engine drive is switched off, the vacuum pump according to the invention for a motor vehicle can be driven by the electric motor. Here, the requirements with regard to sound development during operation of the vacuum pump for a motor vehicle when the internal combustion engine drive is switched off are higher than in conventional motor vehicles, in which the vacuum pump for a motor vehicle is driven by the internal combustion engine drive. According to a first aspect of the invention, the decoupling element serves to acoustically decouple the acoustic enclosure, in particular with regard to solid-borne sound and/or vibrations which occur during operation of the vacuum pump for a motor vehicle. As a result of the acoustic decoupling of the acoustic enclosure which is brought about by way of the decoupling element, undesired sound development can be reduced considerably during operation of the vacuum pump for a motor vehicle. According to a second aspect of the invention, the decoupling element represents a seal between the pump housing face and the acoustic enclosure with respect to the surroundings of the vacuum pump for a motor vehicle. A separate seal between the pump housing face and the acoustic enclosure can therefore be dispensed with. According to a third aspect of the invention, a valve is integrated into the decoupling element. The valve prevents undesired penetration of foreign particles or water into a delivery space or working space of the vacuum pump for a motor vehicle. As a result of the combination according to the invention of the three functions in the multifunctional decoupling element, the number of required individual parts can be reduced. As a result, the manufacture and the assembly of the vacuum pump for a motor vehicle are simplified.

One preferred exemplary embodiment of the vacuum pump for a motor vehicle is distinguished by the fact that the multifunctional decoupling element is formed in one piece from an elastomeric material, in particular plastic material. As a result, the manufacture of the multifunctional decoupling element is simplified considerably. The multifunctional decoupling element is advantageously manufactured using the injection molding process. The elastomeric plastic material, from which the multifunctional decoupling element is formed, is for example, a silicone rubber material.

A further preferred exemplary embodiment of the vacuum pump for a motor vehicle is distinguished by the fact that a valve is integrated into the decoupling element. The valve is advantageously assigned to a passage opening in the pump housing face. The passage opening makes the passage of working medium, such as air, possible from a working space of the vacuum pump for a motor vehicle into the interior of the acoustic enclosure. The valve makes the discharge of the working medium possible from the working space of the pump into the interior of the acoustic enclosure. However, the valve prevents an undesired backflow from the interior of the acoustic enclosure back into the working space. As a result, in particular, undesired penetration of foreign particles or water from the interior of the acoustic enclosure into the working space is prevented.

A further preferred exemplary embodiment of the vacuum pump for a motor vehicle is distinguished by the fact that the valve is configured as a duckbill valve. A duckbill-like valve body of the duckbill valve is preferably directed away from the pump housing face into the interior of the acoustic enclosure.

A further preferred exemplary embodiment of the vacuum pump for a motor vehicle is distinguished by the fact that the valve is arranged offset with respect to an outlet opening in the acoustic enclosure. The outlet opening in the acoustic enclosure makes the discharge of working medium, such as air, possible from the interior of the acoustic enclosure into the surroundings of the vacuum pump for a motor vehicle. As a result of the offset arrangement of the valve with respect to the outlet opening in the acoustic enclosure, the provision of a labyrinth for the air-borne sound in the interior of the acoustic enclosure is simplified. The valve is preferably arranged diametrically with respect to the outlet opening. Moreover, the valve or the valve body or duckbill of the duckbill valve is arranged in the interior of the acoustic enclosure so as to overlap in the axial direction with respect to an outlet channel which surrounds the outlet opening. This arrangement has proven particularly advantageous with regard to the operating sounds of the vacuum pump for a motor vehicle.

A further preferred exemplary embodiment of the vacuum pump for a motor vehicle is distinguished by the fact that the decoupling element has at least one annular bead on a side which faces the acoustic enclosure. The annular bead serves to provide the sealing function. At least two annular beads are preferably arranged concentrically or coaxially.

A further preferred exemplary embodiment of the vacuum pump for a motor vehicle is distinguished by the fact that the decoupling element has at least one annular bead on a side which faces the pump housing face. The annular bead serves to provide the sealing function. Two annular beads are preferably arranged concentrically or coaxially with respect to one another. The annular beads on the two sides of the decoupling element preferably have identical diameters.

A further preferred exemplary embodiment of the vacuum pump for a motor vehicle is distinguished by the fact that the decoupling element is configured and arranged in such a way that the acoustic enclosure is decoupled acoustically from the pump housing face. The decoupling element prevents, in particular, the transmission of solid-borne sound from a pump housing with the pump housing face to the acoustic enclosure.

A further preferred exemplary embodiment of the vacuum pump for a motor vehicle is distinguished by the fact that the decoupling element, the acoustic enclosure and the pump housing face have different hardnesses such that the acoustic enclosure is decoupled in terms of oscillations from the pump housing face. Here, the decoupling element has the lowest hardness. The pump housing face advantageously has the greatest hardness.

A further preferred exemplary embodiment of the vacuum pump for a motor vehicle is distinguished by the fact that the pump housing face is configured on a pump cover. The pump cover is part of a pump housing which delimits a working space of the vacuum pump for a motor vehicle.

A further preferred exemplary embodiment of the vacuum pump for a motor vehicle is distinguished by the fact that the pump cover with the pump housing face is formed from an aluminum material. The aluminum material, from which the pump cover is formed, preferably has a considerably greater hardness than the decoupling element. The aluminum material is advantageously a spray-formed aluminum material.

A further preferred exemplary embodiment of the vacuum pump for a motor vehicle is distinguished by the fact that the decoupling element has substantially the shape of a circular disk. The size of the circular disk is advantageously dimensioned in such a way that the decoupling element covers the entire pump housing face.

A further preferred exemplary embodiment of the vacuum pump for a motor vehicle is distinguished by the fact that fastening eyelets are configured radially on the outside of the decoupling element. The fastening eyelets are advantageously connected in one piece to a circular disk-like main body of the decoupling element. The fastening eyelets serve for fastening means to be guided through them, such as screws.

A further preferred exemplary embodiment of the vacuum pump for a motor vehicle is distinguished by the fact that the fastening eyelets are connected in one piece to collar sleeves. The collar sleeves serve to acoustically decouple the fastening means, in particular screws, from the acoustic enclosure.

Furthermore, the invention relates to a decoupling element for an above-described vacuum pump for a motor vehicle. The decoupling element can be marketed separately.

A further preferred exemplary embodiment of the vacuum pump for a motor vehicle is distinguished by the fact that the acoustic enclosure has a three-dimensional sound dissipation structure on at least one inner face which faces the pump housing face. The vacuum pump for a motor vehicle is preferably configured as a vane cell pump and is driven by an electric motor. In a motor vehicle, the vacuum pump for a motor vehicle serves to generate a vacuum. The motor vehicle is preferably configured as a hybrid vehicle with an internal combustion engine drive and a further drive, for example an electric motor drive. When the internal combustion engine drive is switched off, the vacuum pump according to the invention for a motor vehicle can be driven by the electric motor. Here, the requirements with regard to sound development during operation of the vacuum pump for a motor vehicle when the internal combustion engine drive is switched off are higher than in conventional motor vehicles, in which the vacuum pump for a motor vehicle is driven by the internal combustion engine drive. The sound dissipation structure according to the invention advantageously makes a frequency shift possible which has an advantageous effect on the sound development during operation of the vacuum pump for a motor vehicle. Moreover, the sound dissipation structure makes an increase in the strength of the acoustic enclosure possible. The sound dissipation structure delimits the sound dampening volume in the interior of the acoustic enclosure. The pump housing face is spaced apart from the sound dissipation structure.

A further preferred exemplary embodiment of the vacuum pump for a motor vehicle is distinguished by the fact that the sound dissipation structure comprises a honeycomb structure. The honeycomb structure has proven particularly advantageous in the context of the present invention with regard to an improvement in the acoustic properties of the acoustic enclosure. Moreover, an increase in strength of the acoustic enclosure can be achieved by way of the honeycomb structure in a simple way.

A further preferred exemplary embodiment of the vacuum pump for a motor vehicle is distinguished by the fact that the sound dissipation structure has a multiplicity of depressions. The depressions are preferably distributed substantially homogeneously over one face or the entire inner area of the acoustic enclosure. The arrangement and configuration of the depressions is optimized with regard to the acoustic properties of the acoustic enclosure.

A further preferred exemplary embodiment of the vacuum pump for a motor vehicle is distinguished by the fact that the depressions in each case have a polygonal, in particular hexagonal, outline. The polygonal outline of the depressions is preferably six-sided or hexagonal. The depressions advantageously form polyhedrons, the faces of which are optimized with regard to the acoustic properties of the acoustic enclosure.

A further preferred exemplary embodiment of the vacuum pump for a motor vehicle is distinguished by the fact that at least one damping body which is made from a sound damping material and does not extend into or extends only partially into the sound dissipation structure is arranged in the sound damping volume. The sound damping material is preferably a plastic foam, in particular a melamine foam. Sound can be absorbed in the interior of the acoustic enclosure in a simple way by way of the sound damping material.

A further preferred exemplary embodiment of the vacuum pump for a motor vehicle is distinguished by the fact that the acoustic enclosure is configured in a pot-like manner with a circular cylindrical shell-like main body and an outwardly domed bottom. The circular cylindrical shell-like main body delimits the damping volume in the interior of the acoustic enclosure in the radial direction. The preferably convexly outwardly domed bottom delimits the damping volume in the interior of the acoustic enclosure in the axial direction. The term axial relates to a rotational axis of the vacuum pump of a motor vehicle, in particular of a rotor of the vacuum pump of a motor vehicle. Axial means in the direction of or parallel to the rotational axis of the vacuum pump of a motor vehicle. Radial means transverse with respect to the rotational axis of the vacuum pump of a motor vehicle.

A further preferred exemplary embodiment of the vacuum pump of a motor vehicle is distinguished by the fact that the sound dissipation structure is configured on the inside of the outwardly domed bottom of the acoustic enclosure. This arrangement has proven particularly advantageous in the context of the present invention. Moreover, the configuration of the sound dissipation structure on the inside of the outwardly domed bottom can be manufactured simply and inexpensively.

A further preferred exemplary embodiment of the vacuum pump for a motor vehicle is distinguished by the fact that sound dissipation structural elements are configured on the inside of the circular cylindrical shell-like main body of the acoustic enclosure. These are preferably ribs which extend in the axial direction. The ribs advantageously have a triangular cross section which tapers to a point radially toward the inside.

A further preferred exemplary embodiment of the vacuum pump for a motor vehicle is distinguished by the fact that the circular cylindrical shell-like main body of the acoustic enclosure has reinforcing ribs on the outside. By way of the reinforcing ribs, the strength of the acoustic enclosure can be increased considerably in a simple way.

A further preferred exemplary embodiment of the vacuum pump for a motor vehicle is distinguished by the fact that the acoustic enclosure has an outlet opening. The outlet opening makes the discharge of working medium, in particular air, possible from the interior of the acoustic enclosure. The outlet opening preferably extends substantially in the axial direction.

A further preferred exemplary embodiment of the vacuum pump for a motor vehicle is distinguished by the fact that the acoustic enclosure has a supporting structure on the outside, which supporting structure surrounds the outlet opening.

The supporting structure comprises, for example, a plurality of column-like projections, the free ends of which provide bearing faces for a covering of the outlet opening. A covering of this type prevents undesired entry of contaminants through the outlet opening into the interior of the acoustic enclosure. Here, however, the covering still makes the discharge of working medium, such as air, possible from the interior of the acoustic enclosure through the outlet opening to the outside.

A further preferred exemplary embodiment of the vacuum pump for a motor vehicle is distinguished by the fact that the acoustic enclosure has a circumferential edge which is angled away in a flange-like manner. The circumferential edge which is angled away in a flange-like manner is preferably equipped with a plurality of fastening eyelets. The fastening eyelets serve for fastening means to be guided through them.

A further preferred exemplary embodiment of the vacuum pump for a motor vehicle is distinguished by the fact that the acoustic enclosure is formed in one piece from a plastic material. The plastic material, from which the acoustic enclosure is formed, advantageously differs, in particular with regard to its hardness, from a further material, from which a pump housing cover with the pump housing face is formed. The pump housing cover with the pump housing face is advantageously formed from an aluminum material, in particular a spray-formed aluminum material. The acoustic enclosure having the features which are described above can advantageously be manufactured using the injection molding process.

A further preferred exemplary embodiment of the vacuum pump for a motor vehicle is distinguished by the fact that the acoustic enclosure is formed from a fiber-reinforced polyamide material. This is advantageously a polyamide material having the code designation PA66GF30.

Furthermore, the invention relates to an acoustic enclosure for an above-described vacuum pump for a motor vehicle. The acoustic enclosure can be marketed separately.

DRAWINGS

Figure 2:
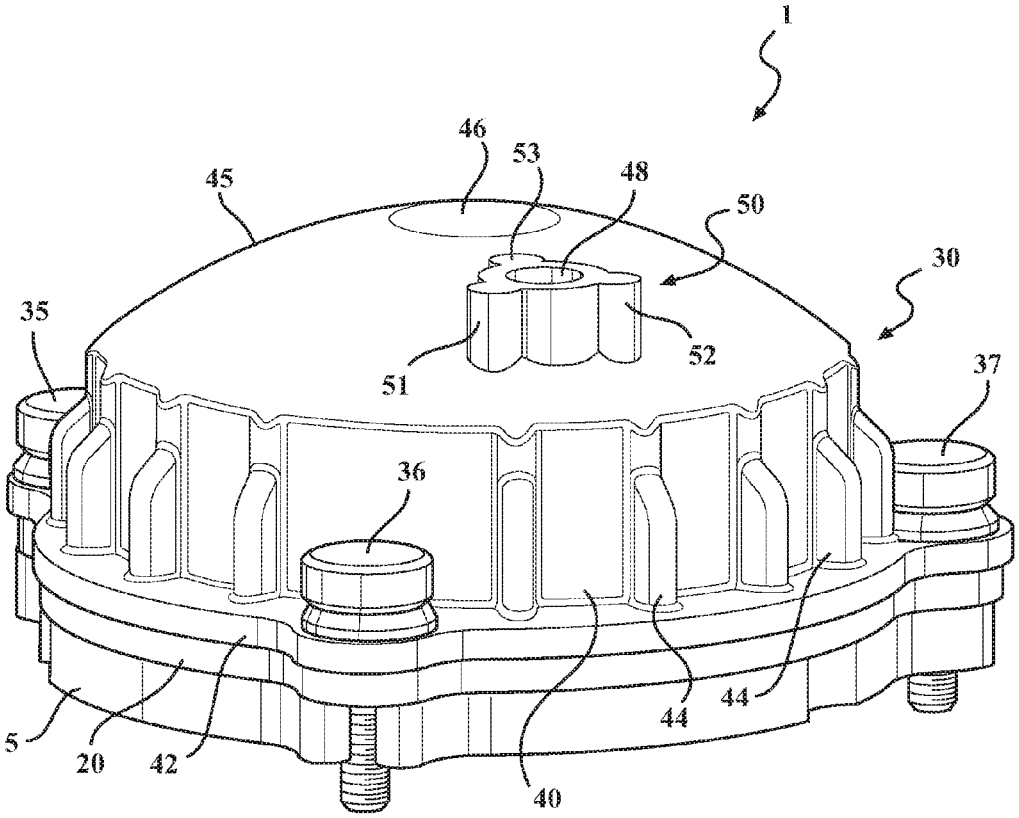
Figure 3:
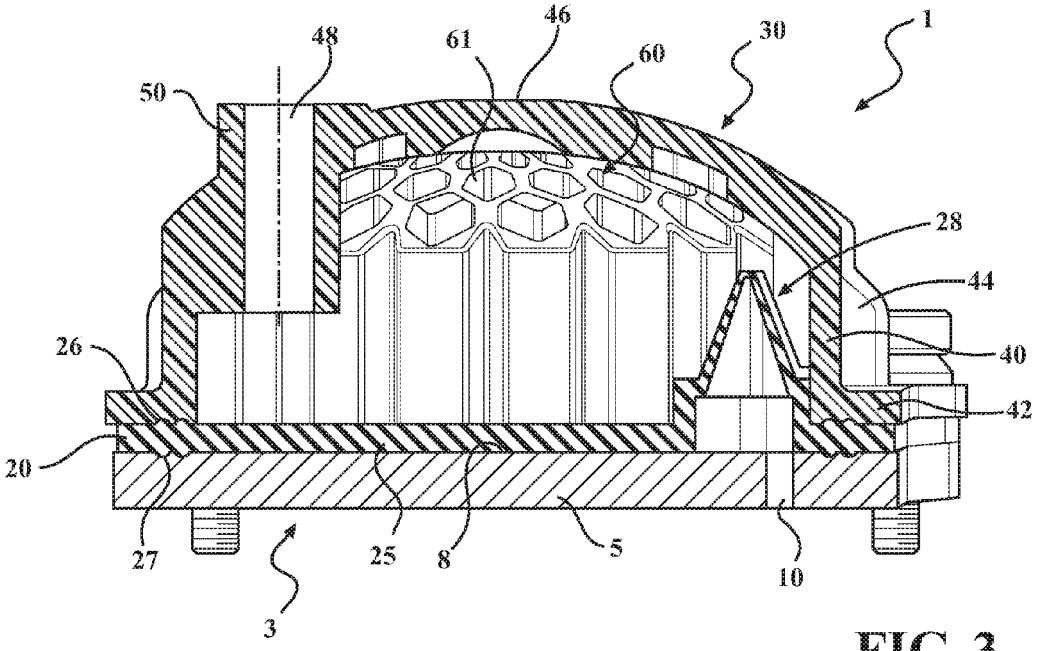
Figure 4:
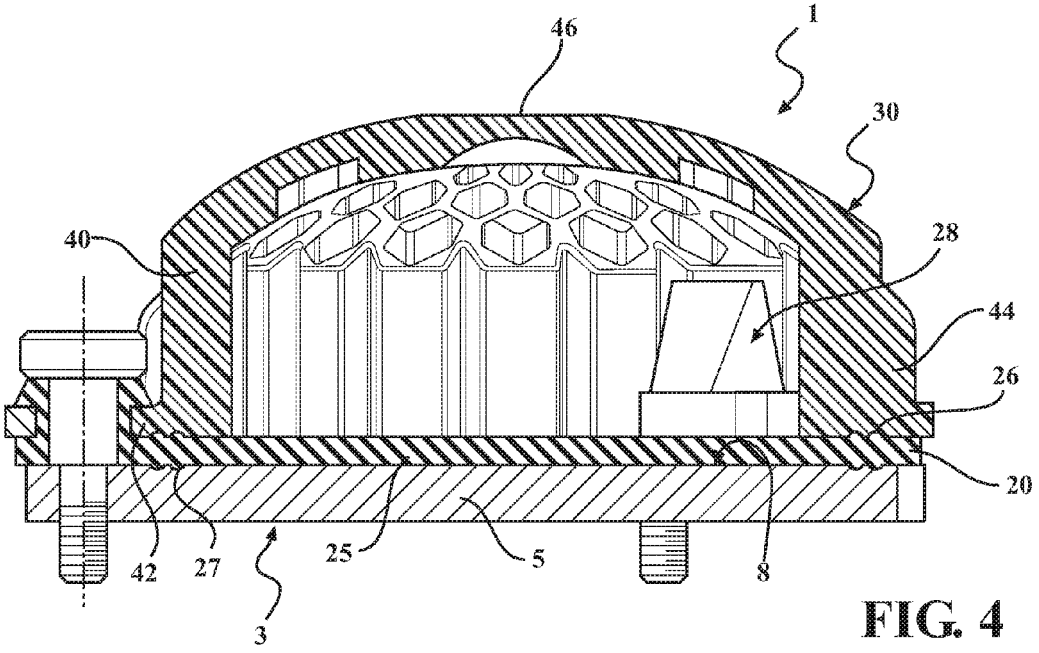
Figure 5:
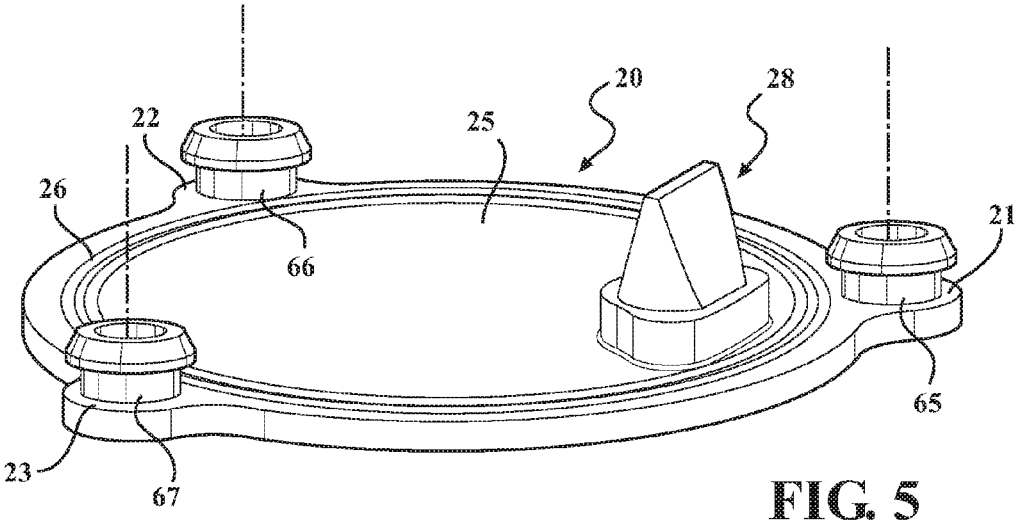
Figure 6:
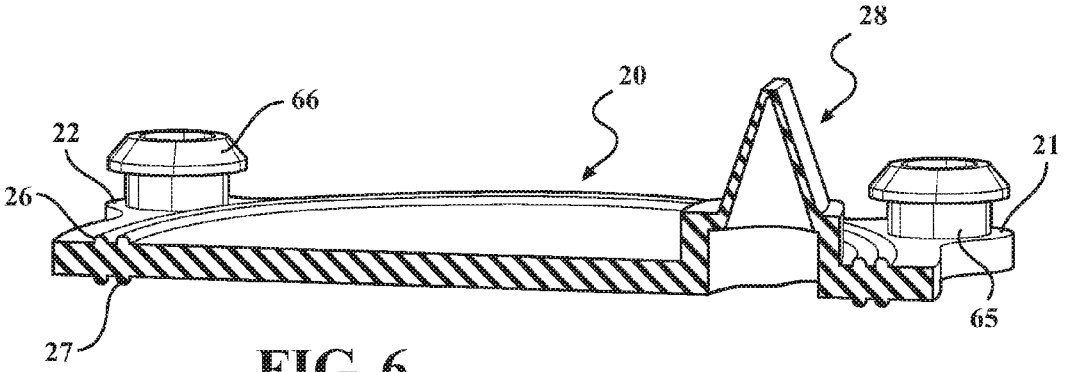
Figure 7:
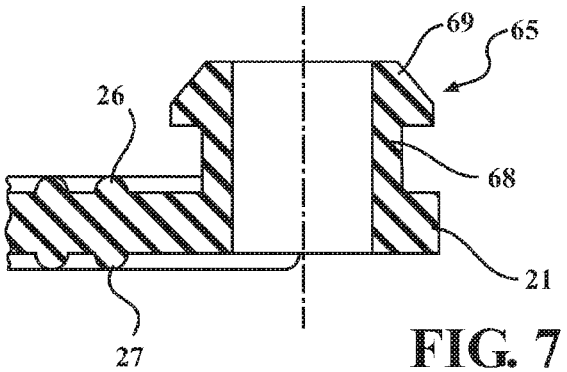
Figure 8:
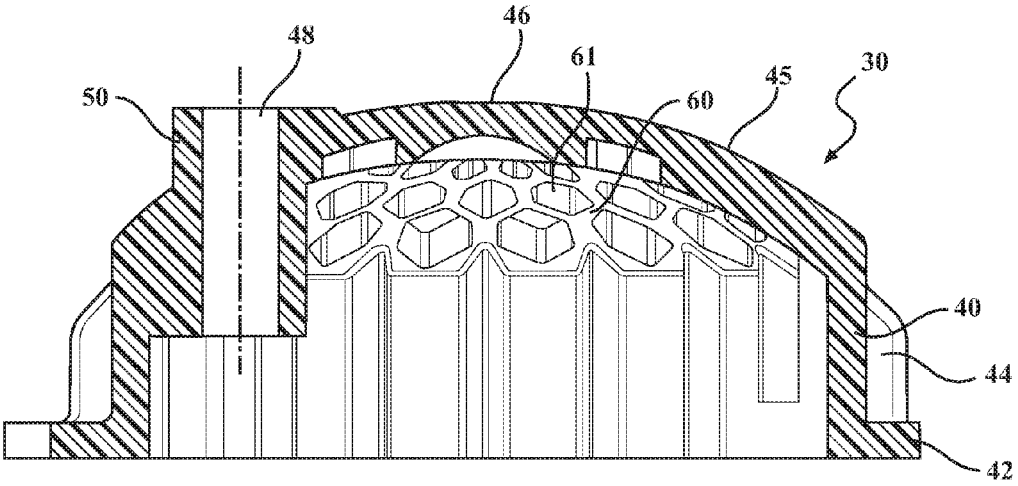
Figure 9:
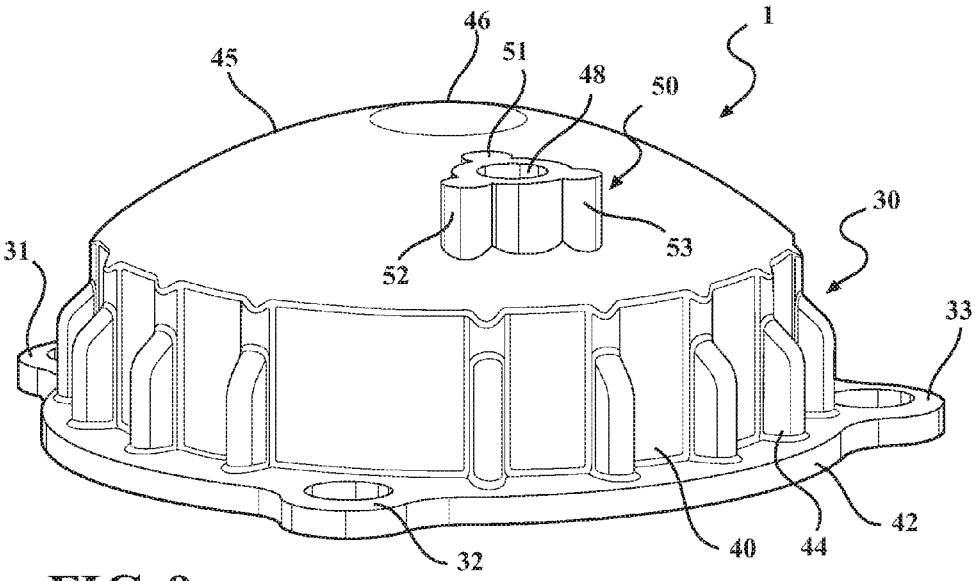
Figure 10:
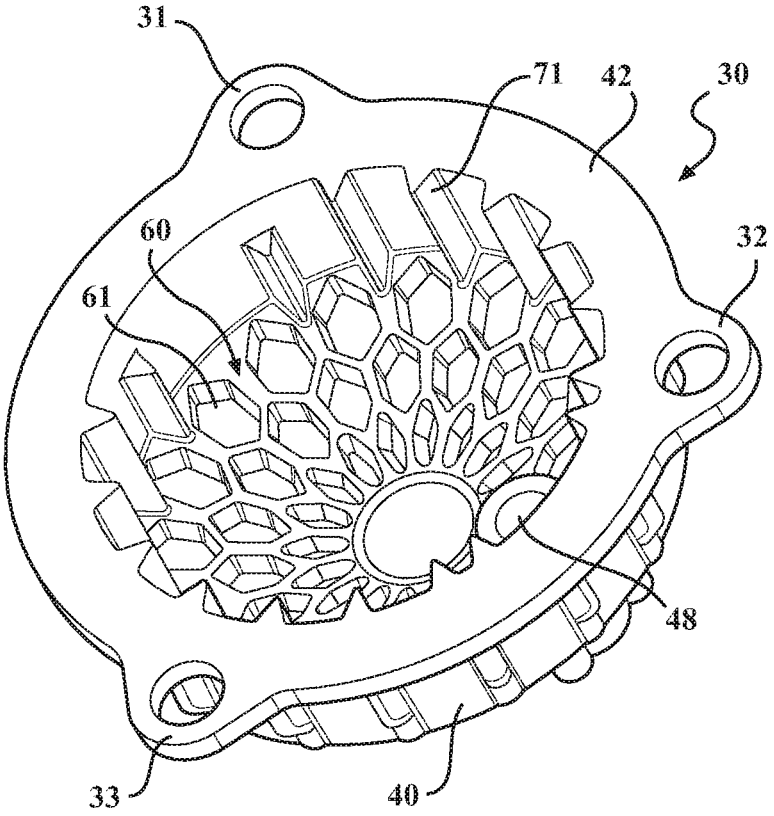
Figure 11:
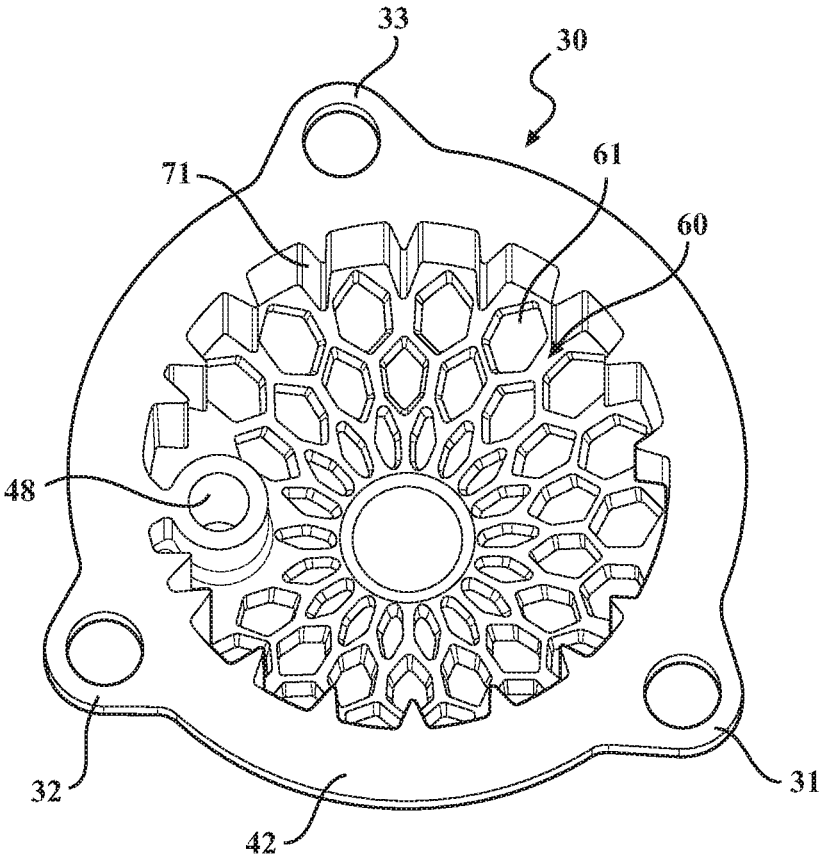

Further advantages, features and details of the invention result from the following description, in which various exemplary embodiments are described in detail with reference to the drawing, in which:

FIG. 1 shows an exploded illustration of a vacuum pump according to the invention for a motor vehicle, FIG. 2 shows a perspective illustration of the vacuum pump for a motor vehicle from FIG. 1, FIG. 3 shows the vacuum pump for a motor vehicle from FIGS. 1 and 2 in a first longitudinal section, FIG. 4 shows the vacuum pump for a motor vehicle from FIGS. 1 and 2 in a second longitudinal section, FIG. 5 shows a perspective illustration of a decoupling element of the vacuum pump for a motor vehicle from FIGS. 1 to 4, FIG. 6 shows a perspective sectional illustration of the decoupling element from FIG. 5, FIG. 7 shows an enlarged detail from FIG. 6 in section, FIG. 8 shows an acoustic enclosure of the vacuum pump for a motor vehicle from FIGS. 1 to 4 in longitudinal section, FIG. 9 shows a perspective illustration of the acoustic enclosure from FIG. 8 obliquely from above, FIG. 10 shows a perspective illustration of the acoustic enclosure from FIGS. 8 and 9 obliquely from below, and FIG. 11 shows a perspective illustration of the acoustic enclosure from FIGS. 8 to 10 from below.

DETAILED DESCRIPTION

FIGS. 1 to 4 show a vacuum pump 1 according to the invention for a motor vehicle having a pump housing 3 in different views. The pump housing 3 comprises a housing pot (not shown) which is screwed to a pump cover 5. A suction connector can be integrated into the housing pot, via which suction connector a working medium, such as air, is sucked into a working space in the interior of the pump housing 3 when the vacuum pump 1 for a motor vehicle is driven.

The vacuum pump 1 for a motor vehicle is configured as a vane cell pump with a plurality of vanes and a rotor. The rotor is drive-connected to an electric motor. The general construction and the function of a vane cell pump are described, for example, in the international publications WO 2004/074687 A2 and WO 2011/134448 A2.

The vacuum pump 1 for a motor vehicle which is driven by the electric motor is operated without lubricant, that is to say in an oil-free manner. The vacuum pump 1 for a motor vehicle which is operated in an oil-free manner and is driven by an electric motor is installed into a motor vehicle which, in addition to an internal combustion engine drive, comprises a further drive, for example an electric motor drive.

When the internal combustion engine drive is switched off, the vacuum pump 1 for a motor vehicle which is driven by the electric motor is then operated in the motor vehicle, in order to generate a vacuum, for example in a brake booster which is configured as a vacuum booster. By way of the design according to the invention of the vacuum pump 1 for a motor vehicle, undesired sound development can be reduced during operation, in particular when the internal combustion engine drive of the motor vehicle is at a standstill or is switched off.

With its side which faces away from a pump housing face 8, the pump cover 5 delimits the working space of the vacuum pump 1 for a motor vehicle. A passage opening 10 is provided in the pump housing face 8, which passage opening 10 makes the passage of working medium, in particular air, possible from the working space of the vacuum pump 1 for a motor vehicle. The passage opening 10 is configured as a slot and has the form of a circular arc in plan view. On account of its shape, the passage opening 10 is also called a passage kidney.

The pump cover 5 with the pump housing face 8 has substantially the shape of a circular disk, on which three fastening recesses 11, 12, 13 are configured radially on the outside. The fastening recesses 11 to 13 delimit through holes which serve for fastening means to be guided through them.

The pump cover 5 is formed from an aluminum material. The aluminum material is preferably a spray-formed aluminum material. The spray-formed aluminum material preferably has a silicon content of more than 15% and contains hard material particles. The aluminum material is preferably present in an alloy which, in addition to silicon, can also contain other elements, such as iron or nickel. The hard material particles are preferably formed from silicon carbide.

A decoupling element 20 and an acoustic enclosure 30 are attached to the pump housing face 8 of the pump cover 5. The decoupling element 20 has substantially the same shape as the pump cover 5, but is formed from a different material than the pump cover 5. Three fastening eyelets 21, 22, 23 are configured radially on the outside of the decoupling element 20, which fastening eyelets 21, 22, 23 serve, together with the fastening recesses 11 to 13 on the pump cover 5, for fastening the acoustic enclosure 30 of the decoupling element 20 and the pump cover 5 to the pump housing pot (not shown).

The decoupling element 20 separates the acoustic enclosure 30 in terms of oscillations from the pump cover 5. For this purpose, the decoupling element 20 is formed from a silicone rubber material which is relatively soft in comparison with the aluminum material, from which the pump cover 5 is formed. The silicone rubber material preferably has a Shore hardness of from 30 to 40. As a result, it can be advantageously prevented that solid-borne sound is transmitted from the pump cover 5 to the acoustic enclosure 30. The acoustic enclosure 30 is decoupled in terms of oscillations from the pump cover 5 by way of the decoupling element 20.

In addition to the sound decoupling function, the decoupling element 20 also performs a sealing function. The decoupling element 20 comprises a main body 25 which has substantially the shape of a circular disk. In each case two annular beads 26; 27 are configured radially on the outside of the main body 25 on both sides.

It can be seen in FIGS. 5 to 7 that the two annular beads 26 are configured on that face of the decoupling element 20 which faces the pump housing face 8. The two annular beads 27 are configured on that face of the decoupling element 20 which faces away from the pump housing face 8.

Here, the annular beads 26; 27 have the shape of circular rings which are arranged coaxially with respect to one another. The annular beads 26; 27 have the shape of circular segments in cross section and are connected in one piece to the main body 25 of the decoupling element 20. The fastening eyelets 21 to 23 which are likewise connected in one piece to the main body 25 of the decoupling element 20 are configured radially outside the annular beads 26; 27.

Moreover, the decoupling element 20 performs a valve function. For this purpose, a valve 28 is integrated into the decoupling element 20. The valve 28 is configured as a duckbill valve and is connected in one piece to the main body 25 of the decoupling element 20. The duckbill of the valve 28 extends from the pump housing face 8 into the interior of the acoustic enclosure 30.

Here, as is seen, for example, in FIG. 3, the valve 28 is arranged above the passage opening 10 of the pump cover 5. Working medium, such as air, which escapes through the passage opening 10 therefore passes through the valve 28 into the interior of the acoustic enclosure 30.

The acoustic enclosure 30 is shown on its own in various views in FIGS. 8 to 11. Radially on the outside, the acoustic enclosure 30 has a fastening flange with three fastening eyelets 31, 32, 33. The fastening eyelets 31 to 33 serve for screws 35, 36, 37 to be guided through them, with the aid of which screws 35, 36, 37 the acoustic enclosure 30 can be fastened together with the decoupling element 20 and the pump cover 5 to the pump housing pot (not shown) of the pump housing 3.

In comparison with the decoupling element 20 and the pump cover 5, the acoustic enclosure 30 is formed from a third material which differs from the materials, from which the pump cover 5 and the decoupling element 20 are formed. The acoustic enclosure 30 is formed from a plastic material which has a different hardness than the materials, from which the pump cover 5 and the decoupling element 20 are formed.

Here, the acoustic enclosure 30 is advantageously formed from a polyamide material, in particular a polyamide material which is reinforced with glass fibers. As a result, firstly the weight of the vacuum pump 1 for a motor vehicle of the acoustic enclosure 30 can be optimized. Moreover, the manufacturing costs of the vacuum pump 1 for a motor vehicle can be reduced. The acoustic enclosure 30 is advantageously manufactured using the injection molding process.

The polyamide material is preferably a polyamide which is reinforced with glass fibers and has the code designation PA66GF30. According to a further aspect of the invention, the polyamide material PA66GF30 serves for sound reduction. Moreover, the plastic material is resistant to chemicals. Polyamide materials of this type are used, for example, for sound reduction in engine covers.

The acoustic enclosure 30 comprises a main body 40 which has substantially the shape of a straight circular cylindrical shell. The main body 40 provides a pot wall of the substantially pot-like acoustic enclosure 30.

A circumferential edge 42 which provides the fastening flange with the fastening eyelets 31 to 33 is angled away from the lower end (in FIGS. 8 and 9) of the main body 40. The fastening eyelets 31 to 33 are connected in one piece to the main body 40. Reinforcing ribs 44 which are connected in one piece to the main body 40 and the circumferential edge 42 are configured radially on the outside of the main body 40.

At its upper end in FIGS. 8 and 9, the main body 40 merges into a convexly outwardly curved domed bottom 45 which provides the pot bottom of the pot-like acoustic enclosure 30. On the outside, the domed bottom 45 has a central circular face 46. Moreover, the convexly outwardly domed bottom 45 has an outlet opening 48 which makes the discharge of working medium, such as air, possible from the interior of the acoustic enclosure 30 into the surroundings of the vacuum pump 1 for a motor vehicle.

In the assembled state of the vacuum pump 1 for a motor vehicle, as is seen, for example, in FIG. 3, the outlet opening 48 is arranged diametrically with respect to the passage opening 10 with the valve 28. As a result of the diametrical arrangement, the outlet opening 48 is spaced apart as far as possible from the passage opening 10 with the valve 28. The outlet opening 48 extends, just like the passage opening 10, substantially in an axial direction. Axial direction means parallel to or in the direction of a rotational axis of the vacuum pump 1 for a motor vehicle.

The outlet opening 48 is surrounded by a supporting structure 50. The supporting structure 50 comprises three columns 51, 52, 53. The free ends of the columns 51 to 53 provide a bearing face for a covering (not shown) which can be arranged somewhat above the outlet opening 48. A covering of this type prevents undesired penetration of contaminants through the outlet opening 48 into the interior of the acoustic enclosure 30. However, the covering is to be configured and arranged in such a way that the discharge of working medium through the outlet opening 48 from the interior of the acoustic enclosure 30 is not impaired or is impaired merely insignificantly.

It is seen in FIGS. 3 to 11 that the acoustic enclosure 30 has an sound dissipation structure 60 on the inside of the domed bottom 45. The sound dissipation structure 60 comprises a multiplicity of depressions 61 which are distributed on the inside over the area of the domed bottom 45. The depressions 61 are of honeycomb-like configuration and in each case have, as viewed in plan view, a substantially hexagonal circumference. Overall, the depressions have the shape of polyhedrons which are optimized for air-borne sound dissipation in the interior of the acoustic enclosure 30.

In order to further optimize the acoustic enclosure 30 with regard to its acoustic properties, a damping body made from a sound absorbing material can be arranged in the interior of the acoustic enclosure 30 between the decoupling element 20 and the domed bottom 45 of the acoustic enclosure 30. The sound absorbing material is advantageously a plastic foam, in particular a melamine plastic foam, for sound absorption.

It is seen in FIGS. 5 to 7 that the fastening eyelets 21 to 23 of the decoupling element 20 are combined in each case with a collar sleeve 65, 66, 67. As is seen in FIG. 7, the collar sleeves 65 to 67 comprise in each case one sleeve 68 which emanates from the respective fastening eyelet 21. A collar 69 is configured at the free end of the sleeve 68. The collar 69 tapers toward the free end of the collar sleeve 65. The collar 69 and the sleeve 68 of the collar sleeve 65 are connected in one piece to the fastening eyelet 21.

It is seen in FIGS. 10 and 11 that the main body 40 of the acoustic enclosure 30 is equipped with a multiplicity of sound dissipation structural elements 71 on its inner side. The sound dissipation structural elements 71 are ribs which are connected in one piece to the main body 40 of the acoustic enclosure 30. The ribs in each case have a triangular cross section which tapers to a point radially to the inside.

LIST OF DESIGNATIONS

1 Vacuum pump for a motor vehicle
3 Pump housing
5 Pump cover
8 Pump housing face
10 Passage opening
11 Fastening recess
12 Fastening recess
13 Fastening recess
20 Decoupling element
21 Fastening eyelet
22 Fastening eyelet
23 Fastening eyelet
25 Main body
26 Annular beads
27 Annular beads
28 Valve
30 Acoustic enclosure
31 Fastening eyelet
32 Fastening eyelet
33 Fastening eyelet
35 Screw
36 Screw
37 Screw
40 Main body
42 Circumferential edge
44 Reinforcing ribs
45 Domed bottom
46 Central circular face
48 Outlet opening
50 Supporting structure
51 Column
52 Column
53 Column
60 Sound dissipation structure
61 Depressions
65 Collar sleeve
66 Collar sleeve
67 Collar sleeve
68 Sleeve
69 Collar
71 Sound dissipation structural element

The invention claimed is:

1. A vacuum pump for a motor vehicle comprising a pump housing having a pump housing face to which an acoustic enclosure is attached and which delimits a sound damping volume, wherein a multifunctional decoupling element is arranged between the pump housing face and the acoustic enclosure, and wherein the decoupling element has at least one annular bead on a side which faces the pump housing face.

2. The vacuum pump for a motor vehicle as claimed in claim 1, wherein the multifunctional decoupling element is formed in one piece from an elastomeric material.

3. The vacuum pump for a motor vehicle as claimed in claim 1, wherein a valve is integrated into the decoupling element.

4. The vacuum pump for a motor vehicle as claimed in claim 3, wherein the valve is a duckbill valve.

5. The vacuum pump for a motor vehicle as claimed in claim 3, wherein the valve is arranged offset with respect to an outlet opening in the acoustic enclosure.

6. The vacuum pump for a motor vehicle as claimed in claim 1, wherein the decoupling element has at least one annular bead on a side which faces the acoustic enclosure.

7. The vacuum pump for a motor vehicle as claimed in claim 1, wherein the decoupling element is arranged in such a way that the acoustic enclosure is decoupled acoustically from the pump housing face.

8. The vacuum pump for a motor vehicle as claimed in claim 1, wherein the decoupling element, the acoustic enclosure and the pump housing face have different hardnesses such that the acoustic enclosure is decoupled in terms of oscillations from the pump housing face.

9. The vacuum pump for a motor vehicle as claimed in claim 1, wherein the pump housing face is on a pump cover.

10. The vacuum pump for a motor vehicle as claimed in claim 9, wherein the pump cover with the pump housing face is formed from an aluminum material.

11. The vacuum pump for a motor vehicle as claimed in claim 1, wherein the decoupling element has the shape of a circular disk.

12. The vacuum pump for a motor vehicle as claimed in claim 1, wherein fastening eyelets extend radially from the outside of the decoupling element.

13. The vacuum pump for a motor vehicle as claimed in claim 12, wherein the fastening eyelets are connected in one piece to collar sleeves.

14. A decoupling element for a vacuum pump for a motor vehicle having a pump housing face to which an acoustic enclosure is attached which delimits a sound damping volume, wherein the decoupling element is arranged between the pump housing face and the acoustic enclosure, wherein the decoupling element is formed in one piece from an elastomeric material, a valve being integrated into the decoupling element, the valve being a duckbill valve, the valve being arranged offset with respect to an outlet opening in the acoustic enclosure, the decoupling element having at least one annular bead on a side which faces the acoustic enclosure, the decoupling element having at least one annular bead on a side which faces the pump housing face, the decoupling element arranged in such a way that the acoustic enclosure is decoupled acoustically from the pump housing face, the decoupling element, the acoustic enclosure and the pump housing face having different hardnesses such that the acoustic enclosure is decoupled in terms of oscillations from the pump housing face, the pump housing face being on a pump cover, the pump cover with the pump housing face being formed from an aluminum material, the decoupling element having the shape of a circular disk, and fastening eyelets extending radially from the outside of the decoupling element, the fastening eyelets being connected in one piece to collar sleeves.

15. A vacuum pump for a motor vehicle comprising a pump housing having a pump housing face to which an acoustical enclosure is attached and which delimits a sound damping volume, and a decoupling element arranged between the pump housing face and the acoustic enclosure, wherein the decoupling element includes fastening eyelets extending radially from outside of the decoupling element, and wherein the fastening eyelets are connected in one piece to collar sleeves.

* * * * *